US006241316B1

(12) United States Patent
Jean et al.

(10) Patent No.: US 6,241,316 B1
(45) Date of Patent: Jun. 5, 2001

(54) APPARATUS FOR ADJUSTING THE HEIGHT OF A SWIVEL CHAIR

(75) Inventors: Young S Jean; Baik H Sung; Ju D Kim; Jong G Lee; Young K Yoon, all of Seoul (KR)

(73) Assignee: Samhongsa Co., Ltd., Seoul (KR)

( * ) Notice: Subject to any disclaimer, the term of this patent is extended or adjusted under 35 U.S.C. 154(b) by 0 days.

(21) Appl. No.: 09/193,245

(22) Filed: Nov. 17, 1998

(30) Foreign Application Priority Data

| | | |
|---|---|---|
| Nov. 17, 1997 | (KR) | 97-32398 |
| Jun. 29, 1998 | (KR) | 98-11376 |
| Jun. 29, 1998 | (KR) | 98-24913 |
| Jul. 14, 1998 | (KR) | 98-12951 |
| Jul. 14, 1998 | (KR) | 98-28313 |

(51) Int. Cl.[7] ..... A47C 1/02

(52) U.S. Cl. ..... 297/344.19; 297/DIG. 3; 277/440; 267/64.12; 248/161; 248/631

(58) Field of Search ..... 248/161, 162.1, 248/404, 157, 631; 297/344.19, 344.18, DIG. 3; 188/313, 314, 316; 267/64.1, 64.26, 124; 277/442, 540

(56) References Cited

U.S. PATENT DOCUMENTS

| | | | | |
|---|---|---|---|---|
| 2,298,584 | * | 10/1942 | Onions | 277/440 X |
| 3,618,960 | * | 11/1971 | Koehler | 277/440 |
| 4,132,417 | * | 1/1979 | Lagerqvist | 277/440 |
| 4,720,068 | * | 1/1988 | Tornero | 248/161 |
| 4,844,392 | | 7/1989 | Bauer et al. | 248/162.1 |
| 5,096,029 | | 3/1992 | Bauer et al. | 188/300 |
| 5,570,873 | * | 11/1996 | Bauer | 267/64.12 |
| 6,056,251 | * | 5/2000 | Knopp et al. | 248/161 |

* cited by examiner

*Primary Examiner*—Laurie K. Cranmer
(74) *Attorney, Agent, or Firm*—Pillsbury Winthrop LLP

(57) ABSTRACT

Disclosed is a gas cylinder type height-adjusting apparatus of a swivel chair which has a simple structure and thereby can be manufactured at a low cost. In the apparatus, an actuating pin opens an orifice so that working fluid can flow from the first chamber through the second chamber into the third chamber when the actuating pin is pressed down, while the actuating pin blocks up the orifice when the actuating pin is not pressed down. The orifice is formed in an actuating pin socket manufactured by coating synthetic resin after an integral single forming of a single material. The first chamber is defined by an alternating piston which is manufactured by coating synthetic resin after an integral single forming of a single material. The shaft bearing member has a shape of a single annular ring whose upper and lower surfaces are curved surfaces curved with a predetermined curvature or tapered surfaces tapered at a predetermined angle.

14 Claims, 20 Drawing Sheets

APPARATUS FOR ADJUSTING THE HEIGHT OF A SWIVEL CHAIR

BACKGROUND OF THE INVENTION

1. Field of the Invention

The present invention relates to an apparatus for adjusting the height of a swivel chair, and more particularly to a gas cylinder type height-adjusting apparatus of a swivel chair which has a simple structure and thereby can be manufactured at a low cost.

2. Description of Prior Art

In general, a swivel chair has a part named as a spindle which performs functions of not only supporting the weight of a person seated thereon but also adjusting the height of the chair according to the physique of the person.

The spindle is an important part of a swivel chair in adjusting the height of the chair and can be classified as two types according to the height-adjusting manner, including a screw-adjusting type using a screw spindle and a gas cylinder type in which usually a nitrogen gas functions as a working fluid.

FIG. 1 is a sectional view of a conventional height-adjusting apparatus of a swivel chair having a gas cylinder type spindle for showing the construction thereof. In FIG. 1, reference numeral 10 designates a spindle having a shape of a cylinder. The spindle 10 is inserted in an outer tube 20 having a larger diameter, and a piston rod 30 is inserted into the spindle 10 through the bottom of the spindle 10.

A top stopper 16 is fixed to the top of the spindle 10, and an actuating protuberance 14 is slidably fitted in the top stopper 16. The actuating protuberance 14 is connected to a height-adjusting lever (not shown) for adjusting the height of the swivel chair. A pushing rod 18 integrally formed under the actuating protuberance 14 is in contact with an actuating pin 19. The actuating pin 19 is slidably fitted in an actuating pin socket 40 so as to slide up and down therein. The actuating pin socket 40, whose more detailed construction will be given later, is fixed in the spindle 10 with providing gas-tight therein.

The outer tube 20 of a cylindrical shape has a spindle support 50 fixed to a lower part of the outer tube 20. The piston rod 30 is fixed to the spindle support 50. The spindle 10 has a spindle neck 12 at an upper part thereof which is tapered so as to be inserted in a seat (not shown) of the chair.

The spindle 10 surrounds a cylinder 44 which has a smaller diameter than the spindle 10. The spindle 10 has a buffer disposed in the spindle 10 for providing a comfortable feeling for the person seated thereon. A thrust bearing 60 is arranged on the spindle support 50 so as to ensure a smooth swivel of the chair with bearing the weight from above. The reference numeral 62 designates a cushion such as a rubber which comes into contact with the bottom of the spindle 10. The cushion 62 buffers the impact on the bottom of the spindle 10 when the spindle 10 is lowered down to its lowermost position.

The bottom of the piston rod 30 is detachably installed on the spindle support 50 by means of a clip 70. In FIG. 1, the reference numeral 52 designates a spindle holding member which is disposed between the spindle 10 and the outer tube 20 so as to hold the spindle 10 in such a manner that the spindle 10 can slide therethrough into and out of the outer tube 20.

FIG. 2 is an enlarged sectional view of the actuating pin socket 40 disposed in the spindle 10 of FIG. 1. As shown, the actuating pin socket 40, shaped roughly like a cylinder, has an actuating pin hole 41 formed through the center of the actuating pin socket 40 in which the actuating pin 19 is fitted. The actuating pin socket 40 also has a plurality of socket O-ring grooves 43 formed around the outer circumferential surface of the actuating pin socket 40 in each of which a socket O-ring 45 is fitted.

The inner center portion of the actuating pin socket 40 forms a central space 46 for passing gas therethrough in which at least two socket O-rings 45 and an inner holder 47 are arranged. The socket O-rings 45 maintain gas-tight in the central space 46, and the inner holder 47 holds the socket O-ring 45 of the inner side and helps smooth sliding of the actuating pin 19. The actuating pin socket 40 has an orifice 42 formed at one side of the actuating pin socket 40. The orifice 42 is connected to an outer space of the cylinder 44. The inner holder 47 has a connecting pore **47*a* formed at one side of the inner holder 47 and connected to the orifice 42**.

Referring to FIG. 2, the actuating pin 19 has a small-diameter portion **19*a* formed at a middle portion of the actuating pin 19. The small-diameter portion 19*a* has a diameter smaller than that of the remaining portion of the actuating pin 19. When the actuating pin 19 is lowered down, the small-diameter portion 19*a* makes a small gap between the actuating pin 19 and the actuating pin socket 40, so that gas filled in a first chamber A can flow into the central space 46 of the actuating pin socket 40 and then into a second chamber B through the orifice 42. In FIG. 2, reference numeral 13 designates a holding washer provided in the actuating pin socket 40 to hold the socket O-rings 45 in the actuating pin socket 40**. Nitrogen gas and oil are filled in the first chamber A, as working gas and fluid.

FIG. 3 is an enlarged sectional view for showing the construction of a piston 80 installed at the top of the piston rod 30 in detail, and FIG. 4 is an enlarged sectional view for showing the operation of the piston 80.

The piston rod 30 has a piston rod head 87 which prevents the piston rod 30 from being separated from the piston 80. The piston 80 has a plurality of inner and outer O-ring grooves in each of which a piston O-ring 82 is fitted to make gas-tight. The piston 80 has various parts which enable the piston 80 to smoothly and closely slide in the cylinder 44 and prevent the piston 80 from coming out of the spindle 10. The bottom of the spindle 10 is bent inward so as to prevent the piston 80 from escaping.

The spindle 10 houses a flange 83 disposed in the bottom thereof and a sealing member 84 disposed on the flange 83 for maintaining gas-tight in the cylinder 44. Between the piston 80 and the sealing member 84, an annulus 85 and a cylinder holder 86 are arranged in order from above. The annulus 85 surrounds a spring ring 88 for fixing the piston 80 to the piston rod 30, and the cylinder holder 86 supports the bottom of the cylinder 44.

Referring to FIG. 4, the cylinder holder 86 has a gas-passing hole **86*a* formed through an outer portion of the cylinder holder 86. The gas-passing hole 86*a* provides a path from the second chamber B to the third chamber C. Therefore, the gas-passing hole 86*a* enables the gas to flow from the first chamber A through the second chamber B into the third chamber C. Arrows in FIG. 4** shows the gas flow from the second chamber B to the third chamber C.

FIGS. 5A and 5B are respectively an exploded and an assembled elevations of the actuating pin 19 employed in the conventional gas cylinder type height-adjusting apparatus shown in FIG.1. The actuating pin 19 has a small-diameter portion **19*a* and two large-diameter portions 19*b*. The small-diameter portion 19*a* is integrally connected to each of the large-diameter portions 19***b* through a sloping portion 19*c*. The lower large-diameter portion 19*b* has an actuating pin neck 19*d* protruding downward from the bottom of the large-diameter portion 19*b*.

Referring to FIG. 5B, the actuating pin neck 19*d* is inserted in a fixing washer 17 and then a holding head 19*e* is assembled at the lower end of the actuating pin neck 19*d*, so as to fix the fixing washer 17 thereto. The fixing washer 17 comes apart from the holding washer 13 when an external force as shown by an arrow in FIG. 2 is applied, while the fixing washer 17 comes into contact with the holding washer 13 when the pressure of the gas filled in the first chamber A is applied to the fixing washer 17. Reference numeral 17*a* designates a fixing washer hole formed at the center of the fixing washer 17 so as to receive the actuating pin neck 19*d*.

FIG. 6 is an enlarged sectional view of the actuating pin 19 and the actuating pin socket 40 for showing the operation of the actuating pin 19 in the actuating pin socket 40. When the actuating protuberance 14 shown in FIG. 1 is pressed by means of the height-adjusting lever (not shown), the pushing rod 18 formed integrally with the actuating protuberance 14 pushes down the actuating pin 19, which state is shown in FIG. 6.

When the actuating pin 19 is pushed down, the small-diameter portion 19*a* of the actuating pin 19 is lowered down so as to make the first chamber A and the central space 46 intercommunicate with each other. In this case, the gas in the first chamber A flows through the central space 46, the connecting pore 47*a* and the orifice 42 into the second chamber B. Moreover, the gas flown into the second chamber B from the first chamber A continues to flow to the third chamber C through the gas-passing hole 86*a* shown in detail in FIG. 4.

FIG. 7 is a sectional view of the conventional height-adjusting apparatus of FIG. 1 for showing the descending operation of the gas cylinder type spindle 10. As the gas in the first chamber A decreases while the gas in the third chamber C increases, the piston 80 is pushed up due to the change of the pressure difference between the two chambers, as shown in FIG. 7. In other words, the pressure of the gas in the third chamber C, which is larger than that in the first chamber A, pushes the piston 80 up and the spindle 10 down, to thereby lower the spindle 10 down because the piston 80 is fixed to the spindle support 50 of the outer tube 20 by means of the piston rod 30.

The above described conventional height-adjusting apparatus of the gas cylinder type has following problems.

First, the actuating pin socket 40 is made of metal, usually of aluminum because it can be easily treated. However, aluminum is very expensive and apt to be damaged in the course of being treated. Therefore, there is a high possibility that the manufactured goods of the actuating pin socket 40 has defects such as scratches on its surface, despite the fact that the actuating pin socket 40 must have a surface of a high accuracy for ensuring the gas-tight characteristic.

Second, the complicated construction of the actuating pin socket 40 increases the manufacturing cost and disturbs its mass production. Third, the socket O-ring 45 and the inner holder 47 assembled with the actuating pin socket 40 increase manufacturing steps and labor power. Fourth, even when all parts of the actuating pin socket 40 excepting the socket O-rings 45 are manufactured by injection molding, there remains a molding line between the upper mold and the lower mold on the actuating pin socket 40, which requires a further finishing step in manufacturing the actuating pin socket 40 and lowers the surface accuracy of the manufactured actuating pin socket 40.

Fifth, the conventional actuating pin 19 must have a high accuracy of its size for ensuring the gas tight characteristic in spite of being made from relatively hard material. However, the actuating pin neck 19*d* for fixing the fixing washer 17 makes the construction of the actuating pin 19 more complicated to thereby require relatively hard labor in its manufacturing, disturb its mass production, and increase its manufacturing cost. Further, the assembling of the holding head 19*e* with the actuating pin neck 19*d* can have an impact on the remaining portions of the actuating pin 19, so as to make distortion in the actuating pin 19, which is not preferable for a part requiring a high accuracy.

Sixth, the piston 80 requires a further manufacturing step of assembling the piston O-ring 82 on the inner and outer surfaces of the piston 80, which increases the required labor and expense. Seventh, it is very difficult to assemble the piston rod 30 with the outer tube 20, and the piston rod 30 is apt to be separated from the outer tube 20 even after the assembling.

FIGS. 8 to 10 show another conventional height-adjusting apparatus of a swivel chair having a screw type spindle. FIG. 8 is an exploded perspective view of the conventional screw type height-adjusting apparatus of a swivel chair, and FIGS. 9 and 10 are perspective views of two types of conventional shaft bearing members employed in the conventional screw type height-adjusting apparatus of FIG. 8.

In FIG. 8, reference numerals 100 and 200 respectively designate an outer tube and a spindle installed in the outer tube. The outer tube 100 is cylindrical, and the spindle 200 has an inner tube 240 of a cylindrical shape and a spindle neck 220 connected integrally to the inner tube 240. The inner tube 240 has a plurality of dents 242 for holding a support ring 320. The spindle neck 220 is tapered so as to be inserted in a seat (not shown) of the chair. The spindle 200 houses an elastic buffer 300 for ensuring comfort of the seated person, a shaft bearing member 500 for ensuring a smooth swivel of the spindle, a rubber ring 600 for maintaining the height of the chair, and a screw nut 700 and a clutch 800 for adjusting the height of the chair.

Reference numerals 120, 320, and 502 respectively designate a spindle guide disposed between the outer tube 100 and the spindle 200 to support them, a support ring disposed between the stopping dents 242 and the elastic buffer 300, and balls fitted in the shaft bearing member 500. Reference numeral 590 designates bearing supports disposed respectively on and beneath the shaft bearing member 500 to protect it.

The spindle 200 also houses a screw shaft 900 passing through the elastic buffer 300, the shaft bearing member 500, the rubber ring 600, the screw nut 700, and the clutch 800. A screw shaft disc 910 is installed at the bottom of the screw shaft 900. The screw shaft disc 910 has a circular screw shaft hole 912 for preventing the screw shaft 900 from idly rotating. A nut support 920 limits descending of the screw nut 700.

The clutch 800 is fixed to the bottom of the spindle 200. The screw nut 700 has a sloping groove 720 and a plurality of teeth grooves 780 respectively formed at the upper and the lower surfaces thereof. The clutch 800 has a plurality of teeth 820 formed on the upper surface thereof. The sloping groove 720 receives the rubber ring 600, and the teeth 820 are engaged with the teeth grooves 780.

Referring to FIG. 9, the shaft bearing member 500 contains a plurality of the balls 502. Therefore, when a weight is loaded, the bearing supports 590 disposed on and beneath the shaft bearing member 500 are in contact with the balls 502, so as to reduce the sliding resistance, thereby ensuring a smooth swivel of the chair. In FIG. 9, reference numeral 504 designates a hole for passing the screw shaft 900 therethrough.

However, the above shaft bearing member 500 has at least four balls 502 for ensuring the smooth swivel of the spindle 200. This structure causes a problem; that is, the metal balls 502 inserted in the shaft bearing member 500 of hard synthetic resin can cause a structural problem. Further, this metal-ball-containing shaft bearing member 500 has many problems such as complicated manufacturing process, problematic durability, and expensive manufacturing cost.

Referring to FIG. 10, the shaft bearing member 500 has an outer cylindrical wall 510 and an inner cylindrical wall 520 integrally connected to each other through a plurality of bridges 530. The bridges 530 have a smaller vertical width than the outer cylindrical wall 510 and the inner cylindrical wall 520. The bridges 530 provide a grease-filling gap 540 between the outer cylindrical wall 510 and the inner cylindrical wall 520 and each of the bridges 530 has a grease-flowing groove 550, so that grease can be filled and freely flow in the grease-filling gap 540 through the grease-flowing grooves 550. The shaft bearing member 500 can be made from material selected between hard synthetic resin and metal. Reference numeral 560 designates a hole formed at the center thereof so as to pass the screw shaft 900 therethrough.

In this type of the shaft bearing member 500 shown in FIG. 10, grease filled in the grease-filling gap 540 protects frictional parts to thereby enhance the durability of the shaft bearing member 500. However, the shaft bearing member 500 has a very complicated structure, because the outer cylindrical wall 510, the bridges 530, and the inner cylindrical wall 520 are integrally connected one another and the shaft bearing member 500 has the grease-filling gap 540 and the grease-flowing groove 550. Therefore, it is difficult to manufacture the metal mold of the shaft bearing member 500, and the manufacturing cost of the shaft bearing member 500 is increased.

SUMMARY OF THE INVENTION

The present invention has been made to overcome the above described problems of the prior arts, and accordingly it is an object of the present invention to provide an apparatus for adjusting the height of a swivel chair, which has a simple structure and remarkably reduces its manufacturing steps and manufacturing cost.

To achieve the above object, the present invention provides an apparatus for adjusting a height of a swivel chair, said apparatus comprising:

an outer tube rotatably fitted in a seat of the swivel chair;

a spindle slidably inserted in the outer tube, the spindle containing a cylinder fixed in the spindle by means of a cylinder holder disposed at a lower portion of the spindle;

a piston rod fixedly contained in the outer tube and slidably inserted in the spindle through a bottom of the spindle;

an actuating pin socket fixed at a top of the cylinder, the actuating pin socket having a socket body and a socket coating coated on the socket body, the socket body having an actuating pin hole and an orifice formed in the socket body, the actuating pin socket being manufactured by an integral single forming;

an actuating pin slidably fitted in the actuating pin hole; and a piston fixed at an upper portion of the piston rod and slidably fitted in the cylinder, the actuating pin socket and the piston defining a first chamber above the cylinder in the cylinder, the spindle and the cylinder defining a second chamber between the spindle and the cylinder, the piston and the cylinder defining a third chamber under the piston in the cylinder, the orifice of the socket body being connected to the second chamber, the second chamber and the third chamber communicating through a gas-passing hole formed through an outer portion of the cylinder holder, the first, the second, and the third chambers containing working fluid, wherein, the actuating pin opens the orifice to communicate the first chamber with the second chamber so that working fluid can flow from the first chamber through the second chamber into the third chamber when the actuating pin is pressed down, while the actuating pin blocks up the orifice when the actuating pin is not pressed down.

It is preferred that the socket body is made from metal and the socket coating is made from elastic material. The socket body has an annular reinforcement protruding outward from a middle portion of the socket body, the orifice being formed through the annular reinforcement. The socket coating has a plurality of annular socket protuberances protruding from an inner and an surfaces of the socket coating, the annular socket protuberances functioning like O-rings.

The piston has a cylindrical piston body and a piston coating coated on the piston body, the piston being manufactured by an integral single forming. The actuating pin has a small-diameter portion, two large-diameter portions, and two sloping portions formed integrally with each other, each of the sloping portions being disposed between the small-diameter portion and each of the large-diameter portions.

More preferably, the apparatus further has a shaft bearing member provided at a bottom of the piston rod in the outer tube to bear a weight transferred through the piston rod, wherein the shaft bearing member has a shape of a single annular ring whose upper and lower surfaces are curved surfaces curved with a predetermined curvature or tapered surfaces tapered at a predetermined angle.

The apparatus also has a retainer washer having a plurality of retaining keys protruding upward or downward from an inner circumference of the retainer washer, the retaining keys being engaged in a plurality of piston rod grooves formed on a cylindrical surface of a lower end of the piston rod, so as to firmly fix the piston rod.

When the actuating pin is pushed down, the small-diameter portion of the actuating pin is lowered down so as to make the first chamber and the central space intercommunicate with each other. In this case, the gas in the first chamber flows through the central space and the orifice into the second chamber. Moreover, the gas flown into the second chamber from the first chamber continues to flow to the third chamber.

As the gas in the first chamber decreases while the gas in the third chamber increases, the piston is pushed up. In this case, the pressure of the gas in the third chamber, which is larger than that in the first chamber, pushes the piston up and the spindle down, to thereby lower the spindle down because the piston is fixed to the spindle support of the outer tube by means of the piston rod.

BRIEF DESCRIPTION OF THE DRAWINGS

The above object, and other features and advantages of the present invention will become more apparent by describing in detail preferred embodiments thereof with reference to the attached drawings, in which.

DESCRIPTION OF THE PREFERRED EMBODIMENTS

Hereinafter, several preferred embodiments of the present invention will be described in detail with reference to the accompanying drawings, especially to FIG. 11A to FIG. 21.

Figure 1:
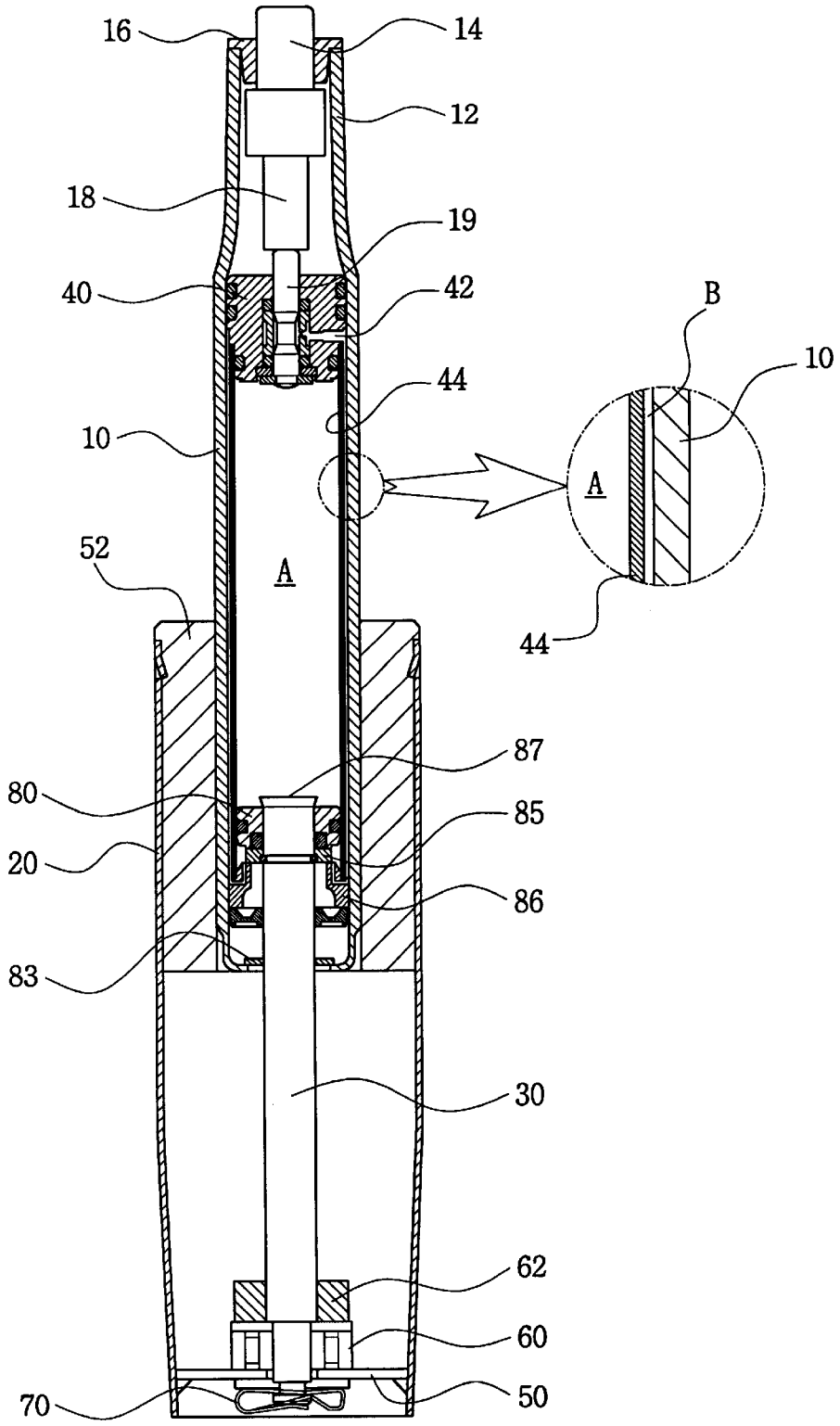
Fig. 1 PRIOR ART
FIG. 1 is a sectional view of a conventional height-adjusting apparatus of a swivel chair having a gas cylinder type spindle.
Figure 2:
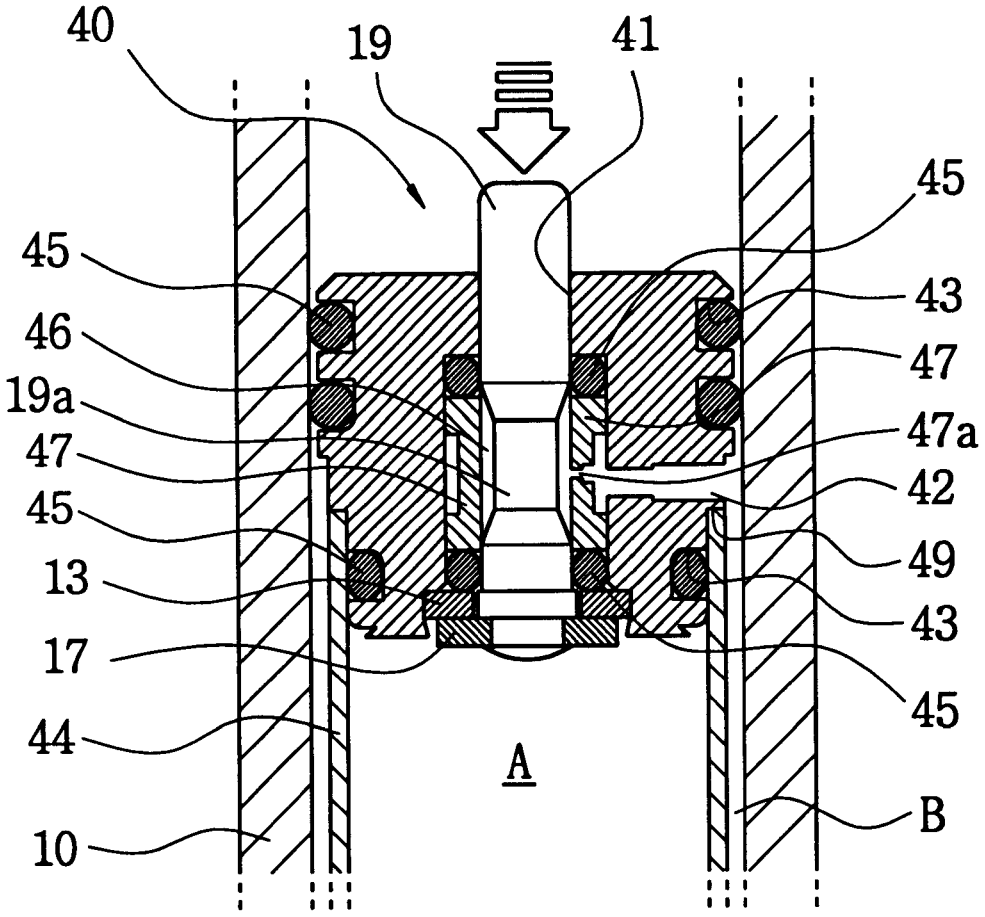
Fig. 2 PRIOR ART
FIG. 2 is an enlarged sectional view of an actuating pin socket disposed in the spindle of FIG. 1.
Figure 3:
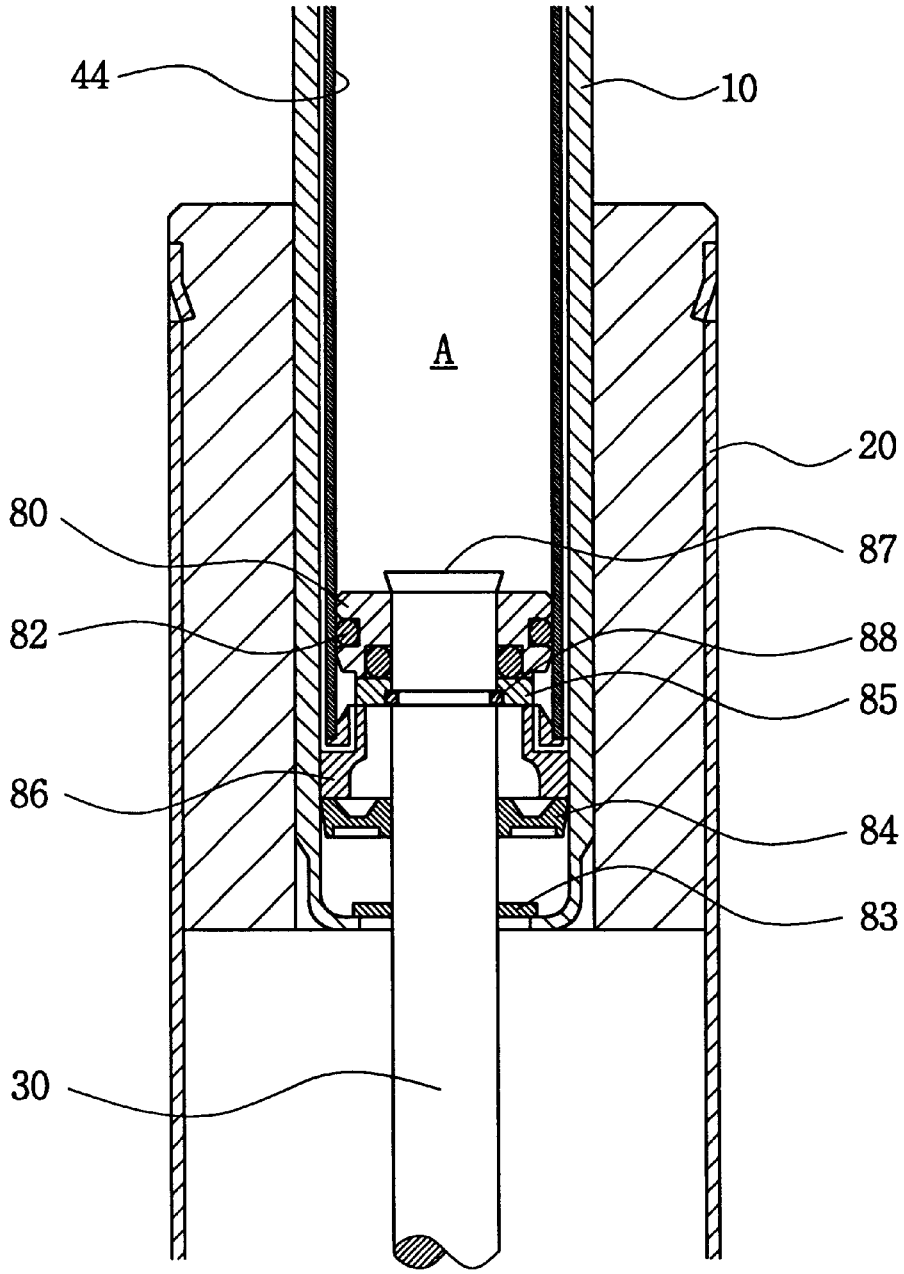
Fig. 3 PRIOR ART
FIG. 3 is an enlarged sectional view of a piston disposed in the spindle of FIG. 1.
Figure 4:
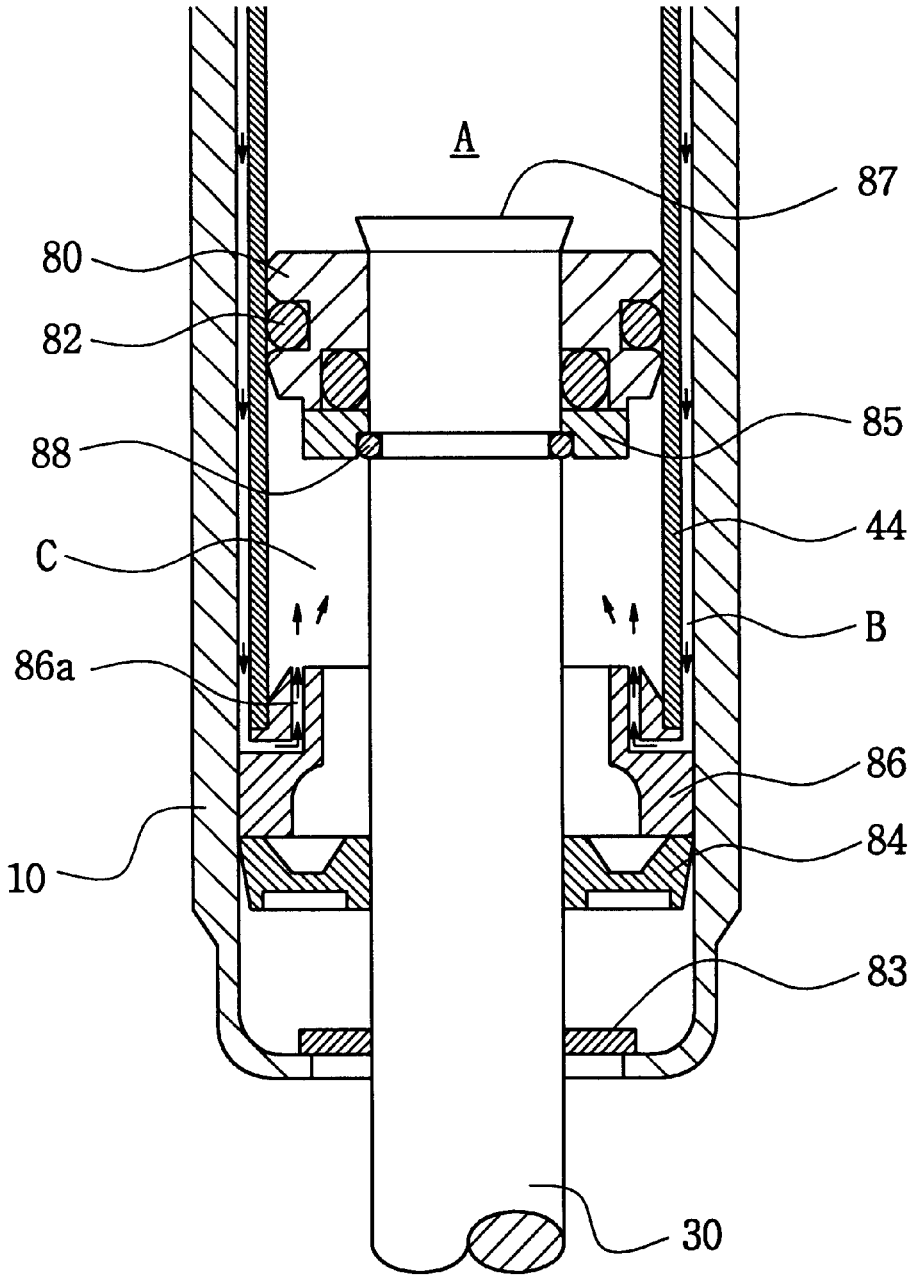
Fig. 4 PRIOR ART
FIG. 4 is an enlarged sectional view of the piston shown in FIG. 3 in its operated state.
Figure 5A:
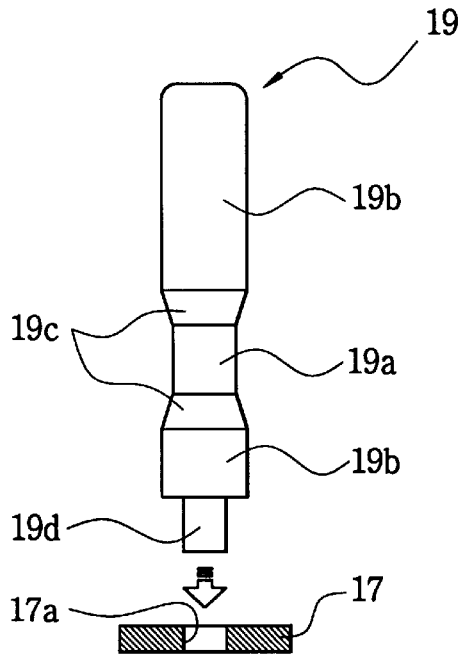
Fig. 5A PRIOR ART
FIGS. 5A and 5B are an exploded and an assembled sectional views of an actuating pin disposed in the spindle of FIG. 1.
Figure 5B:
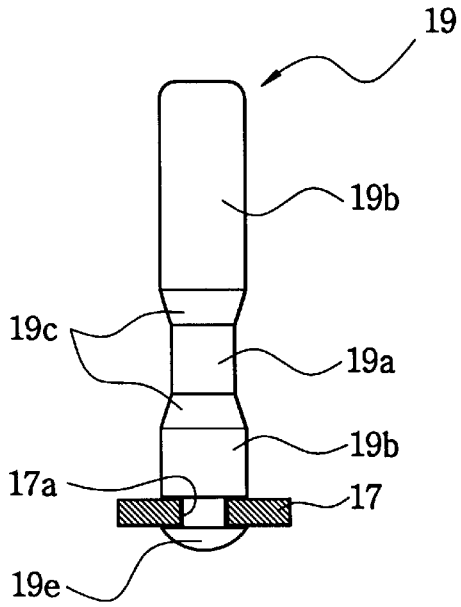
Fig. 5B PRIOR ART
Figure 13:
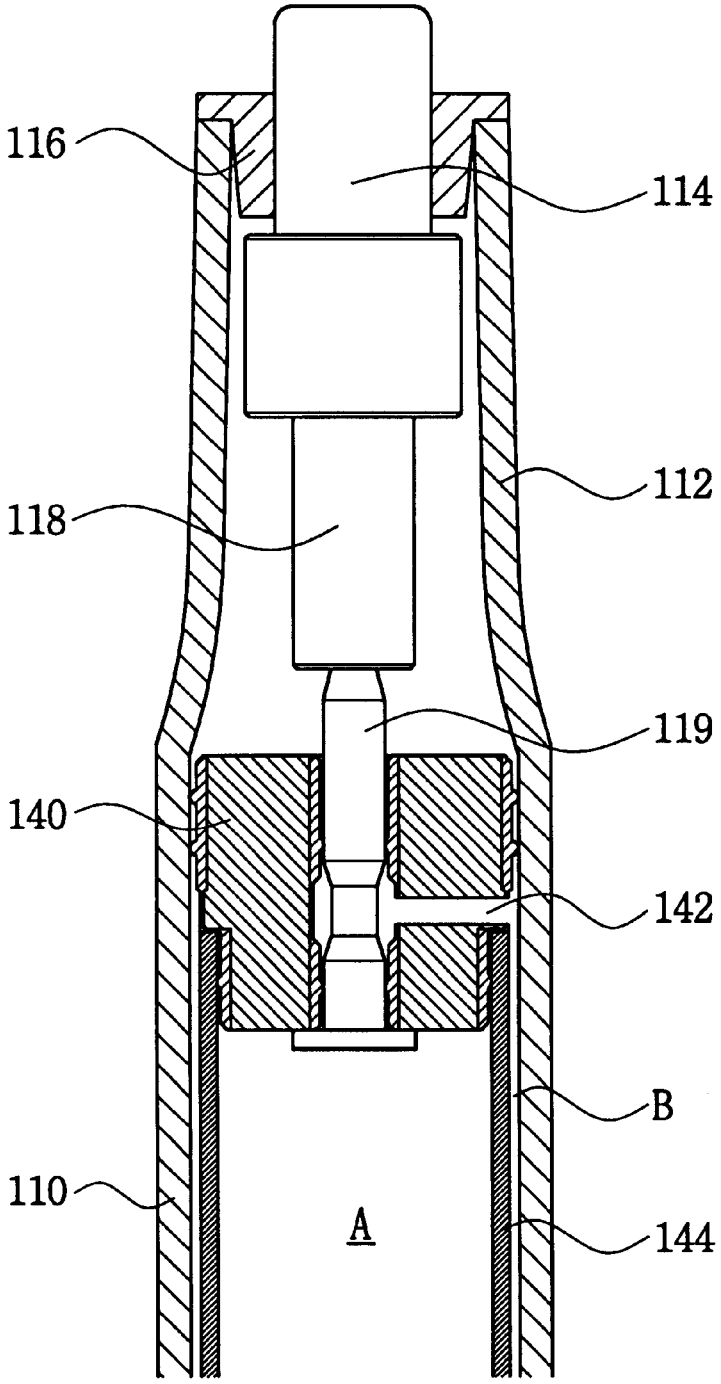
FIG. 13 is a partly cut out enlarged view of a spindle containing the actuating pin socket shown in FIGS. 11A, 11B, 11C and 11D.
Figure 14:
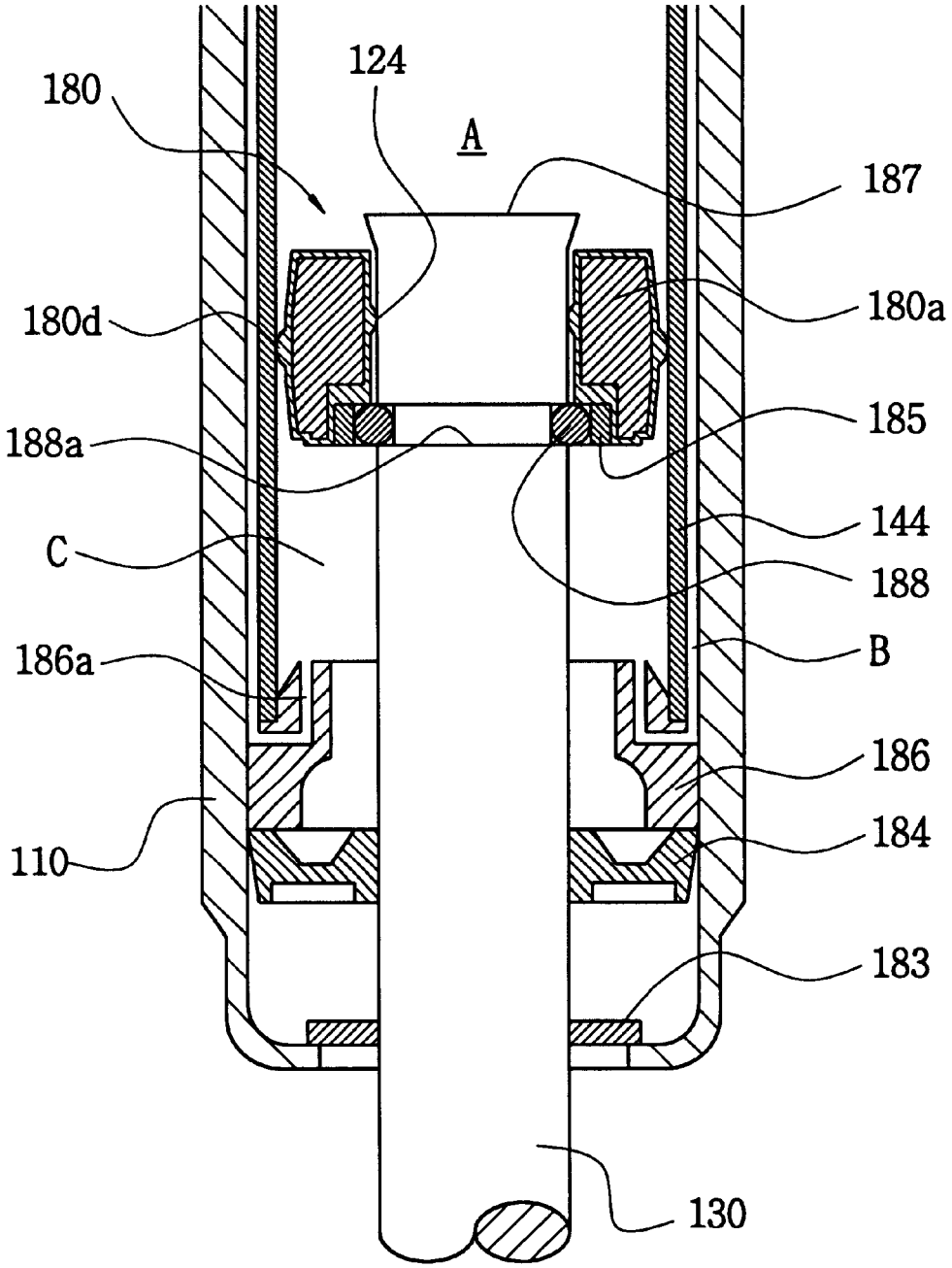
FIG. 14 is a partly cut out enlarged view of a spindle containing the piston shown in FIGS. 12A, 12B and 12C.
Figure 21:
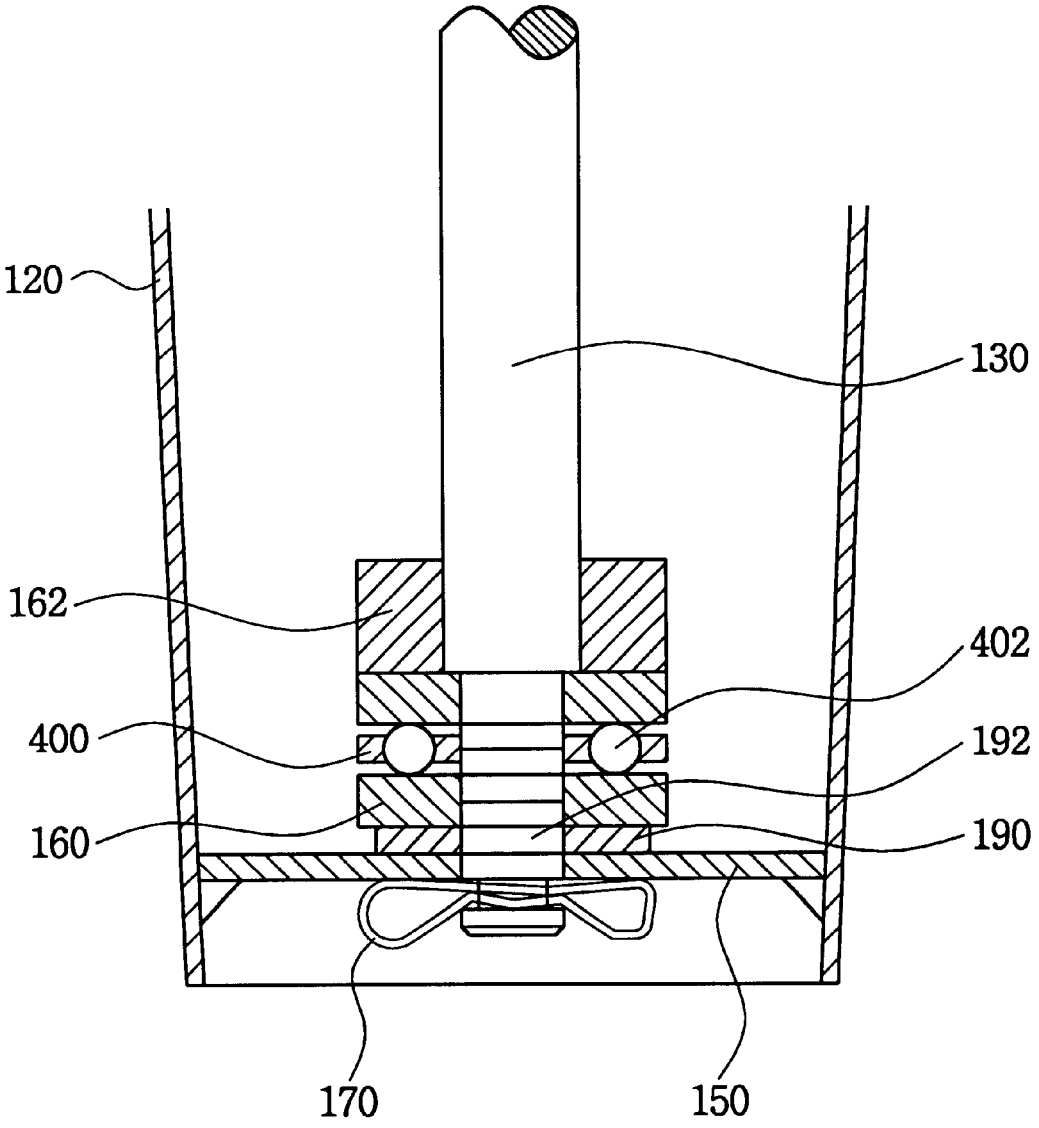
FIG. 21 is a partly cut-out enlarged view of an outer tube according to an embodiment of the present invention, which contains the retainer washer shown in FIG. 20D.

Referring to FIGS. 13, 14 and 21, similarly to the conventional height-adjusting apparatus shown in FIG. 1, a height-adjusting apparatus of a swivel chair according to the present invention includes a spindle 110 of a cylindrical shape, an outer tube 120 having a larger diameter to receive the spindle 110 therein, and a piston rod 130 inserted into the spindle 110 through the bottom of the spindle 110.

Referring to FIG. 13, a top stopper 116 is fixed to the top of the spindle 110, and an actuating protuberance 114 is slidably fitted in the top stopper 116. The actuating protuberance 114 is connected to a height-adjusting lever (not shown) for adjusting the height of the swivel chair. A pushing rod 118 integrally formed under the actuating protuberance 114 is in contact with an actuating pin 119. The actuating pin 119 is slidably fitted in an actuating pin socket 140 so as to slide up and down therein. The actuating pin socket 140, whose more detailed construction will be given later, is fixed in the spindle 110 with providing gas-tight therein.

Referring to FIG. 21, the outer tube 120 has a spindle support 150 fixed to a lower part of the outer tube 120. The piston rod 130 is fixed to the spindle support 150. The spindle 110 has a spindle neck 112 at an upper part thereof which is tapered so as to be inserted in a seat (not shown) of the chair. The bottom of the piston rod 130 is detachably installed on the spindle support 150 by means of a clip 170. The reference numeral 162 designates a cushion such as a rubber which comes into contact with the bottom of the spindle 110. The cushion 162 buffers the impact on the bottom of the spindle 110 when the spindle 110 is lowered down to its lowermost position. A thrust bearing 160 is arranged on the spindle support 150 so as to ensure a smooth swivel of the chair with bearing the weight from above.

Referring to FIG. 14, the piston rod 130 has a piston rod head 187 which prevents the piston rod 130 from being separated from the piston 180. The spindle 110 surrounds a cylinder 144 which has a smaller diameter than the spindle 110. The spindle 110 has a buffer disposed in the spindle 110 for providing a comfortable feeling for the person seated thereon. The bottom of the spindle 110 is bent inward so as to prevent the piston 180 from escaping.

The spindle 110 houses a flange 183 disposed near the bottom thereof and a sealing member 184 disposed on the flange 183 for maintaining gas-tight in the cylinder 144. Between the piston 180 and the sealing member 184, an annulus 185 and a cylinder holder 186 are arranged in order from above. The cylinder holder 186 supports the bottom of the cylinder 144.

The cylinder holder 186 has a gas-passing hole 186*a* formed through an outer portion of the cylinder holder 186. The gas-passing hole 186*a* provides a path from the second chamber B to the third chamber C. Therefore, the gas-passing hole 186*a* enables the gas to flow from the first chamber A through the second chamber B into the third chamber C.

Figure 11A:
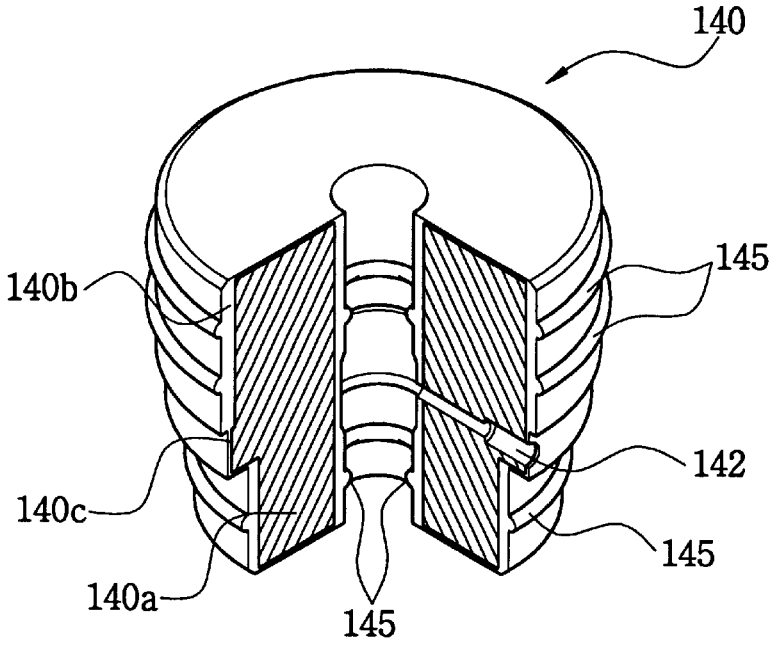
FIGS. 11A, 11B, and 11C are respectively a partly cut-out perspective view, a perspective view, and a sectional view of an actuating pin socket employed in a height-adjusting apparatus of a swivel chair according to the present invention.
Figure 11B:
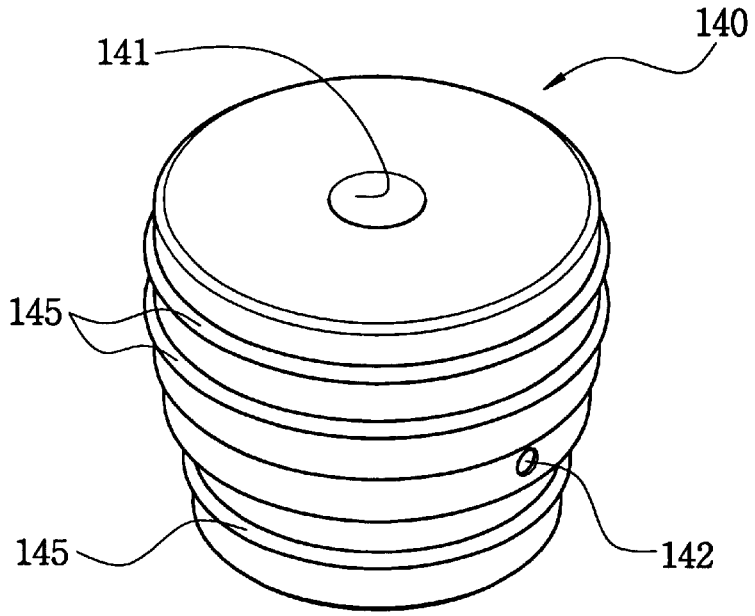
Figure 11C:
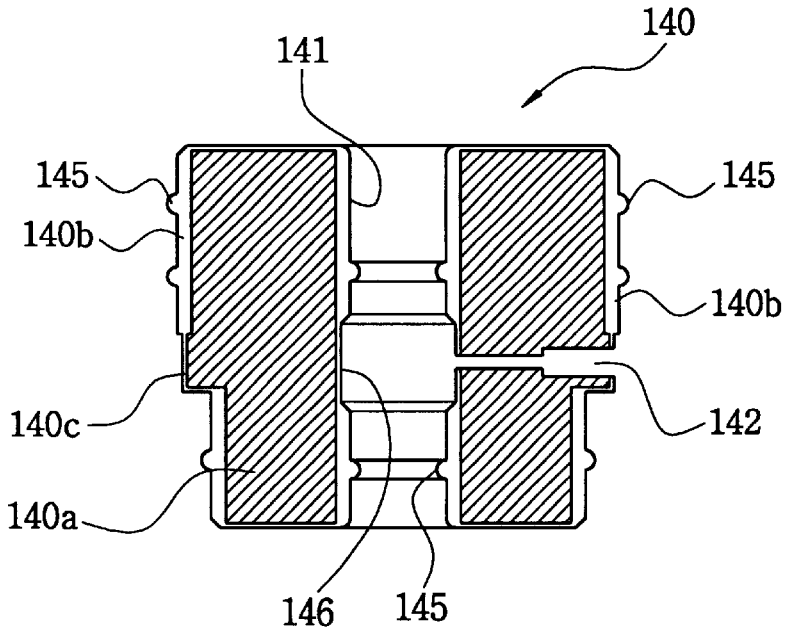
Figure 11D:
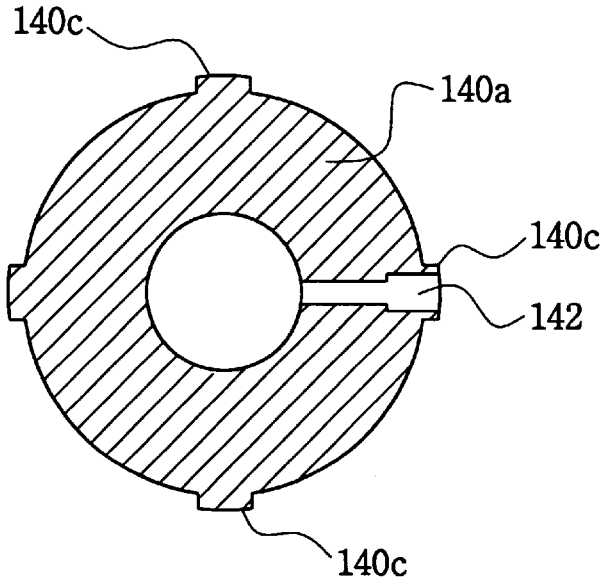
FIG. 11D is a sectional view of a socket body of the actuating pin socket shown in FIGS. 11A, ,11B, and 11C.

FIGS. 11A, 11B, and 11C are respectively a partly cut-out perspective view, a perspective view, and a sectional view of an actuating pin socket 140 employed in the height-adjusting apparatus of a swivel chair according to the present invention as described above, and FIG. 11D is a sectional view of a socket body 140*a* of the actuating pin socket shown in FIGS. 11A, 11B, and 11C.

As shown in detail in FIGS. 11A to 11D, the actuating pin socket 140 is integrally formed from materials of two kinds. The actuating pin socket 140 has a socket body 140*a* made from metal material and a socket coating 140*b* made from elastic material such as rubber. The actuating pin socket 140 has an actuating pin hole 141 formed through the center of the socket body 140*a*. The socket coating 140*b* is coated on the outer surface of the socket body 140*a* and the inner surface of the actuating pin hole 141. The socket body 140*a* has relatively high hardness, while the socket coating 140*b* utilizes the elastic and flexible material to ensure the gas-tight characteristic in the actuating pin hole 141 and an O-ring function by a part of the outer surface of the socket body 140*a*.

The actuating pin socket 140 can be manufactured by an mold, because the socket coating 140*b* is made from elastic material and can be easily escaped from the mold.

It is preferred that the socket body 140*a* has an annular reinforcement 140*c* protruding outward from a middle portion of the socket body 140*a*. The annular reinforcement 140*c* has an orifice 142 of a minute diameter formed through the annular reinforcement 140*c* of metal material, which can not be formed through the socket coating 140*b* of elastic material because the elastic material can block up the minute orifice 142. The annular reinforcement 140*c* compensates for the loss of strength due to the formation of the orifice 142. The socket coating 140*b* has a plurality of annular socket protuberances 145 protruding from the inner and outer surfaces of the socket coating 140*b*.

Figure 12A:
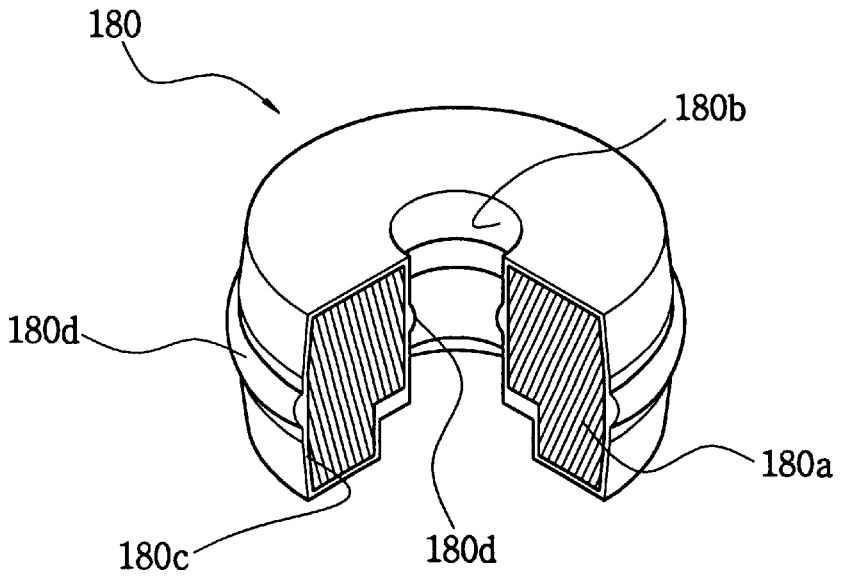
FIGS. 12A, 12B, and 12C are respectively a partly cut-out perspective view, a perspective view, and a sectional view of a piston employed in a height-adjusting apparatus of a swivel chair according to the present invention.
Figure 12B:
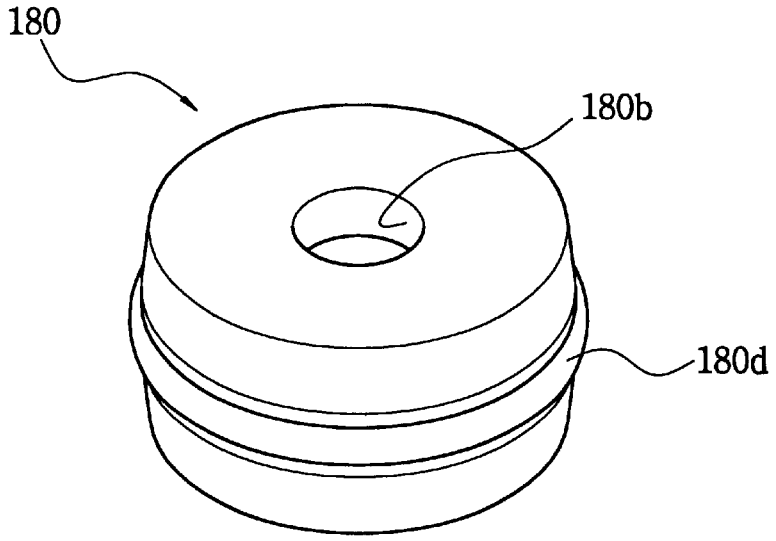
Figure 12C:
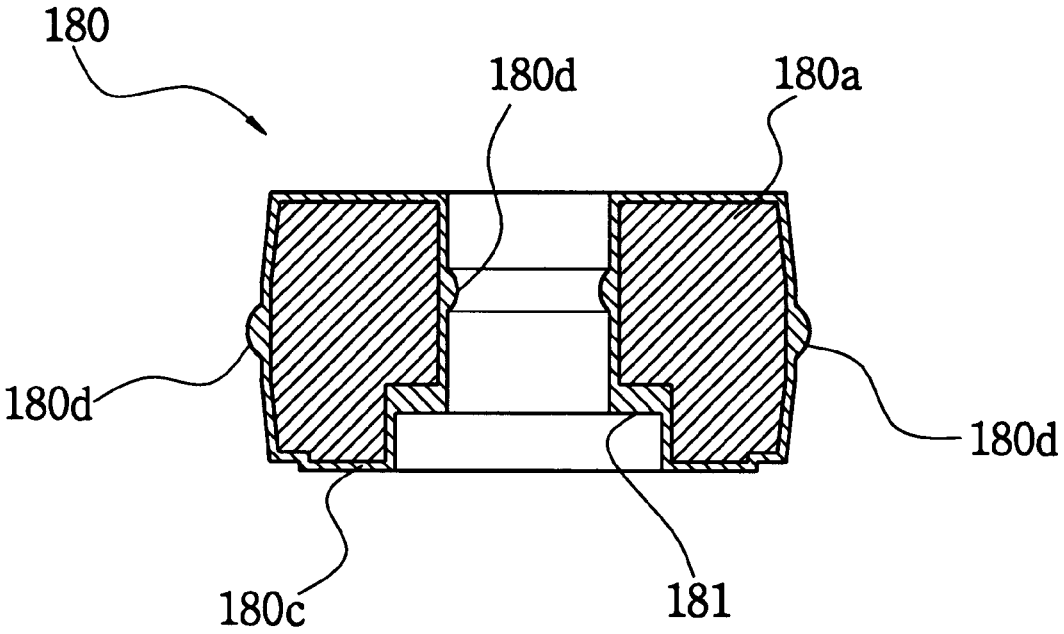

FIGS. 12A, 12B, and 12C are respectively a partly cut-out perspective view, a perspective view, and a sectional view of a piston employed in the height-adjusting apparatus according to the present invention as described above.

As shown, the piston 180 has a piston body 180*a* having a piston rod receiving hole 180*b* formed through the central portion of the piston body 180*a*. The piston body 180*a* is made from metal or hard synthetic resin and coated by a piston coating 180*c* made from elastic resin material such as rubber. The piston coating 180*c* has a plurality of annular protuberances 180*d* protruding from the inner cylindrical surface of the piston coating 180*c* in the piston rod receiving hole 180*b* and the outer cylindrical surface of the piston coating 180*c* coated on the outer surface of the piston body 180*a*.

The annular protuberances 180*d* are made from the same elastic resin material as that of the piston coating 180*c*. When the piston rod 130 fitted in the piston 180 is assembled in the spindle 110, the annular protuberance 180*d* protruding from the inner cylindrical surface of the piston coating 180*c* in the piston rod receiving hole 180*b* is in close contact with the piston rod 130, and the annular protuberance 180*d* protruding from the outer cylindrical surface of the piston coating 180*c* is in close contact with the cylinder 144 contained in the spindle 110, so as to provide gas-tight at the contact area.

Although FIGS. 12A, 12B, and 12C show a piston 180 having one annular protuberance 180*d* at each of the inner and outer surfaces of the piston body 180*a*, the number of the annular protuberance 180*d* may be changed according to necessity.

In the meantime, the piston 180 has a lower central recess 181 formed at the middle of the lower surface of the piston coating 180*c*, as shown in FIGS. 12A and 12C. Further, the piston rod 130 has an annular groove 188*a* corresponding to the lower central recess 181 as shown in FIG. 14. The spring ring 188 and the annulus 185 surrounding the spring ring 188 are inserted in a space between the annular groove 188*a* and the lower central recess 181, to apply a force in a radially inward and outward direction to the annular groove 188*a* and the lower central recess 181, thereby firmly assembling the piston rod 130 and the piston 180 with each other.

As described above, the piston 180 does not require any O-ring member, which is replaced by the annular protuberance 180*d* integrally formed with the piston coating 180*c*. Therefore, the piston 180 of the present invention has a simple construction, which enables the piston 180 to be manufactured by a simple molding and to be mass-produced, thereby remarkably reducing the manufacturing cost.

Figure 15:
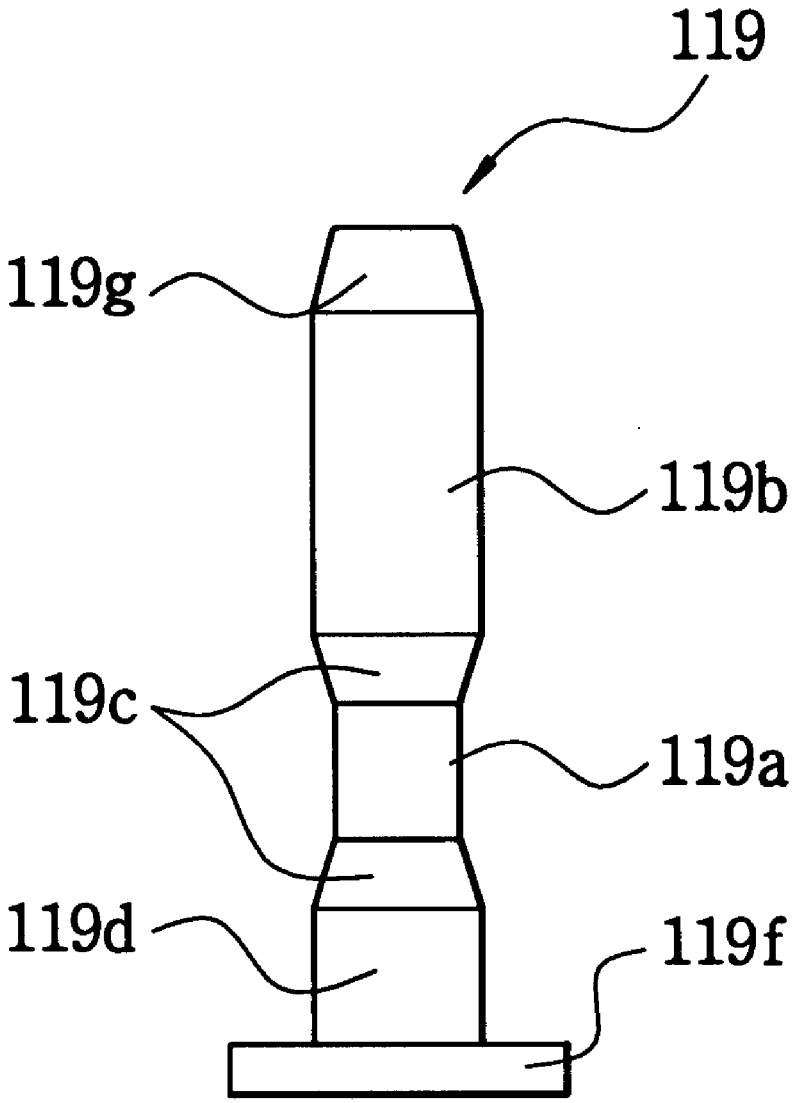
FIG. 15 is an enlarged side elevation of an actuating pin fitted in the actuating pin socket in the spindle shown in FIG. 13.

FIG. 15 is an enlarged side elevation of the actuating pin 119 fitted in the actuating pin socket 140 in the spindle 110 shown in FIG. 13. The actuating pin 119 has a small-diameter portion 119*a*, two large-diameter portions 119*b*, and two sloping portions 119*c* between the small-diameter portion 119*a* and each of the large-diameter portions 119*b*. The large-diameter portion 119*b* at the upper side has a chamfered surface 119*g* chamfered by R 0.2 to R 0.4, while the large-diameter portion 119*b* at the upper side has a washer head 119*f* functioning like a washer.

The entire actuating pin 119 including the small-diameter portion 119*a*, the large-diameter portion 119*b*, the sloping portion 119*c*, the washer head 119*f*, and the chamfered surface 119*g* is integrally formed from a single material. Therefore, the actuating pin 119 can be manufactured only by a finishing treatment after a single forming of the material without the step of assembling a separate washer, which enables mass production of the actuating pin 119 and reduces its manufacturing cost.

Preferably, the surface of the actuating pin 119 may be subject to nitriding, grinding, and then barrel finishing after the formation of the actuating pin 119 as described above, so as to have a surface hardness of HRC 40 to 60. Such a high hardness eliminates pinholes from the surface of the actuating pin 119, thereby improving its gas-tight function. Further, in contrast to the conventional actuating pin consisting of several separate parts assembled together, the actuating pin 119 of the present invention reduces material and labor required in its manufacture, and simplifies its manufacturing process.

Figure 16:
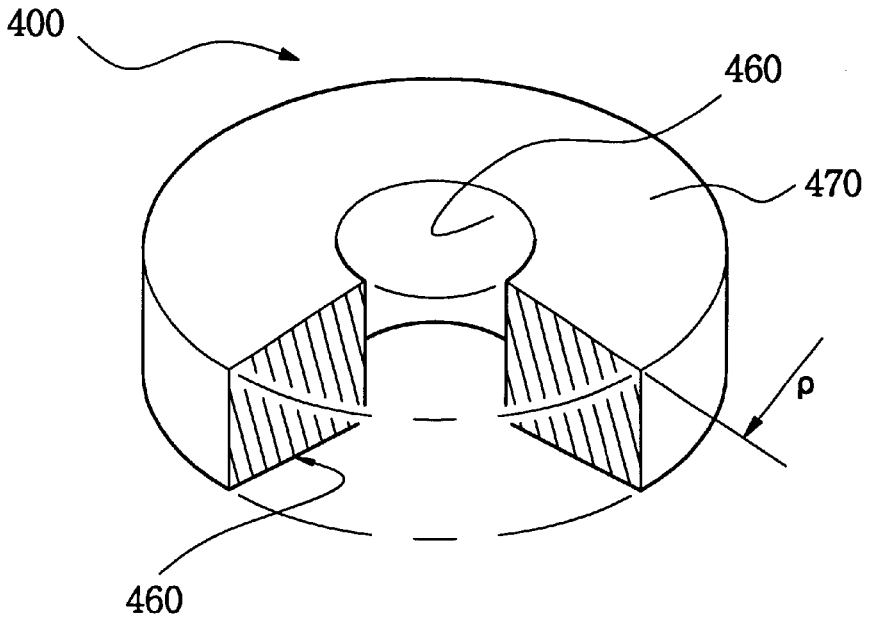
FIGS. 16 and 17 are a partly cut out enlarged view and a sectional view of shaft bearing members according to embodiments of the present invention, which are employed in a height-adjusting apparatus of a swivel chair as shown in FIG. 21.
Figure 17:
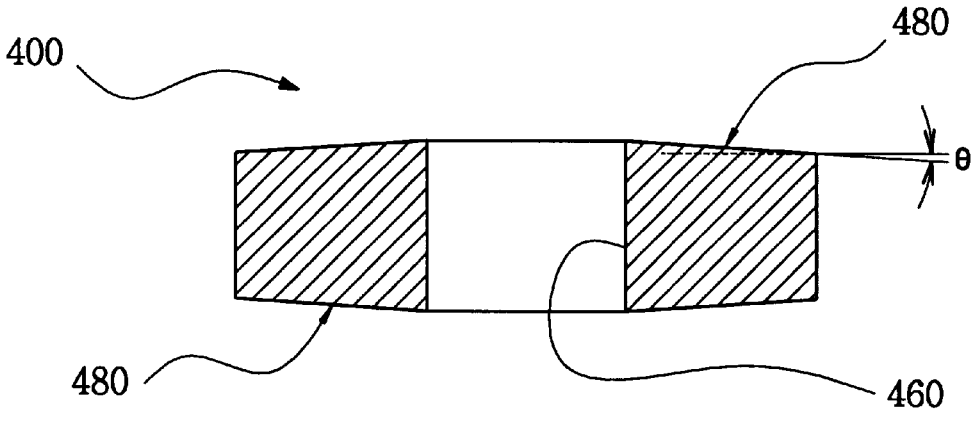

FIGS. 16 and 17 are a partly cut out enlarged view and a sectional view of shaft bearing members 400 according to embodiments of the present invention, which are employed in the height-adjusting apparatus as shown in FIG. 21. The shaft bearing member 400 has a shape of a single annular ring whose upper and lower surfaces are curved surfaces 470 curved with a curvature $\rho$ as shown in FIG. 16 or tapered surfaces 480 tapered at an angle $\theta$ with respect to the horizontal line as shown in FIG. 17. The shaft bearing member 400 has a shaft hole 460 formed through the center of the shaft bearing member 400.

Figure 18:
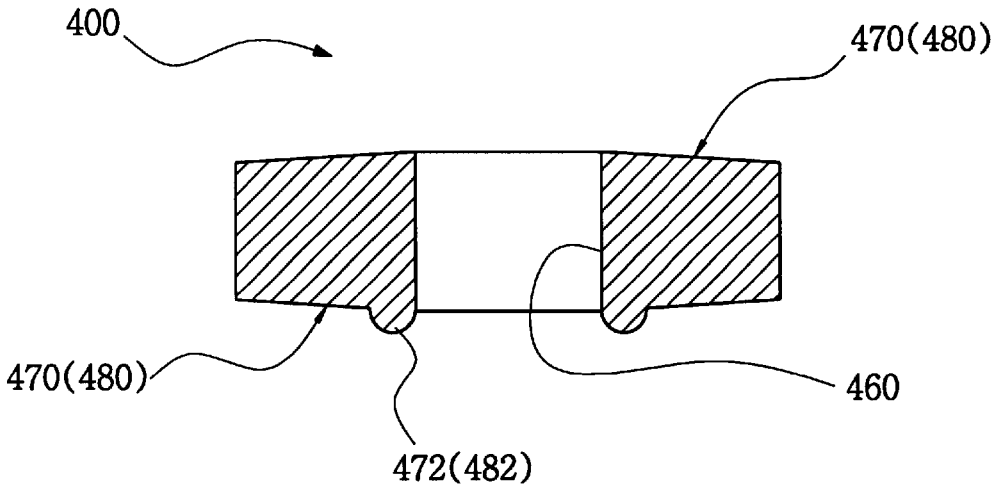
FIGS. 18 and 19 are a sectional view and a plan view of other shaft bearing members according to other embodiments of the present invention, further to the shaft bearing members of FIGS. 16 and 17.
Figure 19:
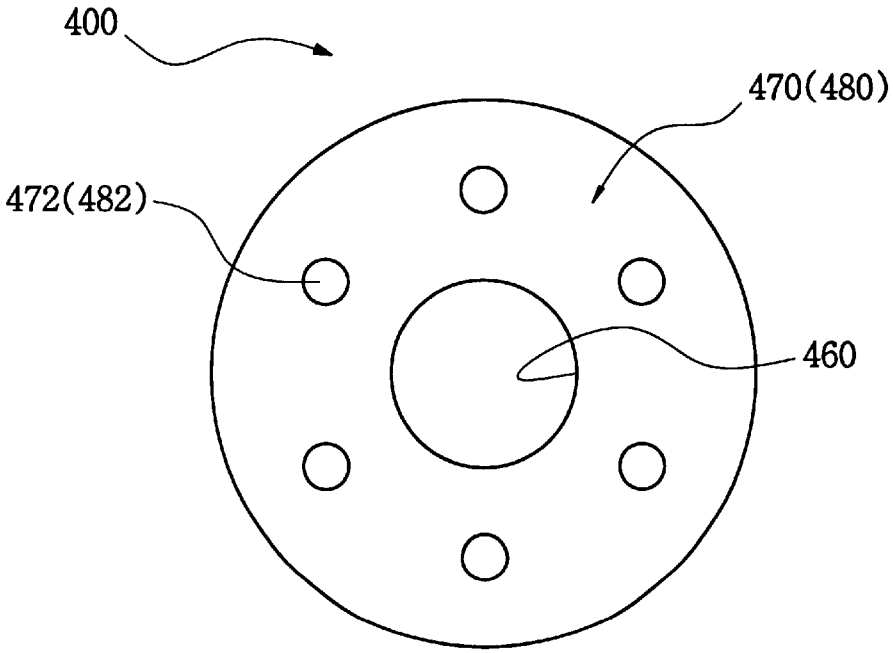

FIGS. 18 and 19 are a sectional view and a plan view of other shaft bearing members 400 according to other embodiments of the present invention, further to the shaft bearing members 400 of FIGS. 16 and 17. The shaft bearing member 400 may be manufactured from a material selected between a hard synthetic resin and a metal.

According to the embodiment shown in FIG. 18, the shaft bearing member 400 has a plurality of bearing protuberances 472 formed around the shaft hole 460 at the lower surface of the shaft bearing member 400. FIG. 19 shows another embodiment in which the bearing protuberances 472 are formed on the curved surface 470 or the tapered surface 480. Although FIG. 19 shows the shaft bearing member 400 having only six bearing protuberances 472, the number of the bearing protuberances 472 may be chosen according to embodiments. The bearing protuberances 472 reduce the sliding resistance.

Figure 20A:
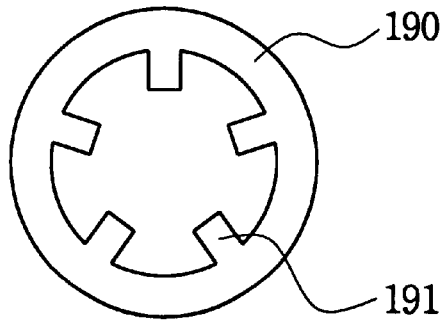
FIGS. 20A, 20B, and 20C are plan views of retainer washers according to several embodiments of the present invention, which are employed in the height-adjusting apparatus of a swivel chair as shown in FIG. 21.
Figure 20B:
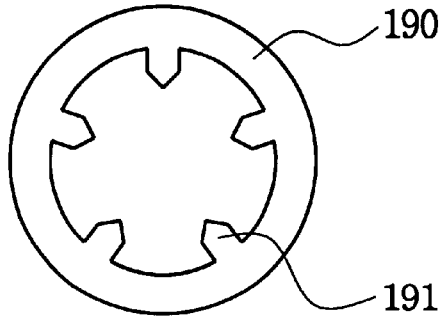
Figure 20C:
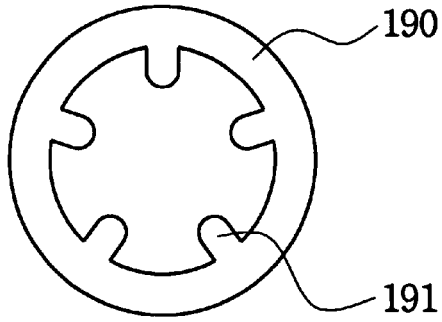
Figure 20D:
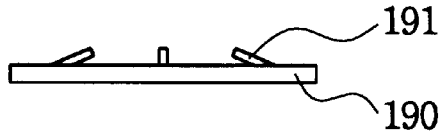
FIG. 20D is a side elevation of the retainer washers shown in FIGS. 20A, 20B, and 20C.

FIGS. 20A, 20B, and 20C are plan views of retainer washers 190 according to several embodiments of the present invention and FIG. 20D is a side elevation of the retainer washers 190, and FIG. 21 is a partly cut-out enlarged view of an outer tube 120 containing the retainer washer 190.

The retainer washer 190 for fixing the piston rod 130 is disposed between the thrust bearing 160 and the spindle support 150. The retainer washer 190 has a plurality of retaining keys 191 protruding upward or downward from the inner circumference of the retainer washer 190. The retaining keys 191 are engaged in plural piston rod grooves 192 having a shape of plural stripes formed on the cylindrical surface of the lower end of the piston rod 130, so as to firmly fix the piston rod 130.

It is preferred that the retainer washer 190 has an outer diameter of 10 mm to 30 mm and an inner diameter of 4 mm to 20 mm, and a thickness of 0.2 mm to 1 mm. The retainer washer 190 is made from metal or hard synthetic resin. Also, the retaining key 191 may have a width of 1 mm to 5 mm and a shape of a rectangle, a triangle, or a semi-circle as shown in FIGS. 20A to 20C, or any other polygon.

This retainer washer 190 assembled with the piston rod 130 simplifies the assembling operation and reduces the working time, when the piston rod 130 is fixed to the spindle support 150 after the cylinder 144 and the piston rod 130 are inserted in the outer tube 120.

Even in case the outer tube 120 and the cylinder 144 are separately handled or stored without being assembled together, the retainer washer 190 can be used to fix various parts such as the cushion 162, the thrust bearing 160, bearing supports, and etc. onto the piston rod 130 after they are fitted around the piston rod 130. Therefore, the retainer washer 190 has a further advantage of easy handling and storing of parts.

Figure 6:
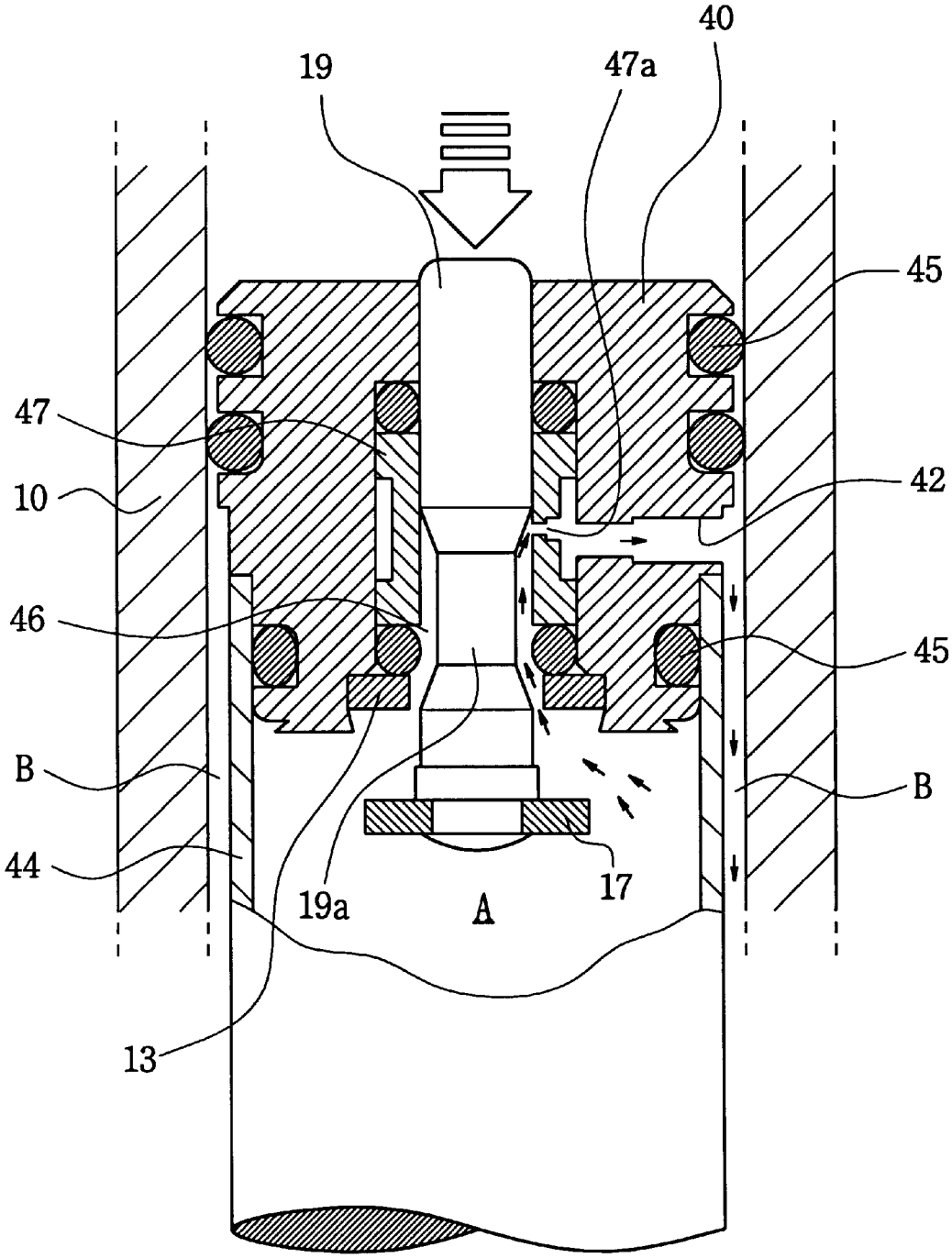
Fig. 6 PRIOR ART
FIG. 6 is an enlarged sectional view for showing the actuating pin shown in FIGS. 5A and 5B.

Hereinafter, the operation of the height-adjusting apparatus of a swivel chair according to the present invention will be described in detail. When the actuating protuberance 114 shown in FIG. 13 is pressed by means of the height-adjusting lever (not shown), the pushing rod 118 formed integrally with the actuating protuberance 114 pushes down the actuating pin 119, similarly to the state shown in FIG. 6.

When the actuating pin 119 is pushed down, the small-diameter portion 119*a* of the actuating pin 119 is lowered down so as to make the first chamber A and the central space 146 intercommunicate with each other. In this case, the gas in the first chamber A flows through the central space 146, the connecting pore 147*a* and the orifice 142 into the second chamber B. Moreover, the gas flown into the second chamber B from the first chamber A continues to flow to the third chamber C through the gas-passing hole 186*a* shown in FIG. 14.

Figure 7:
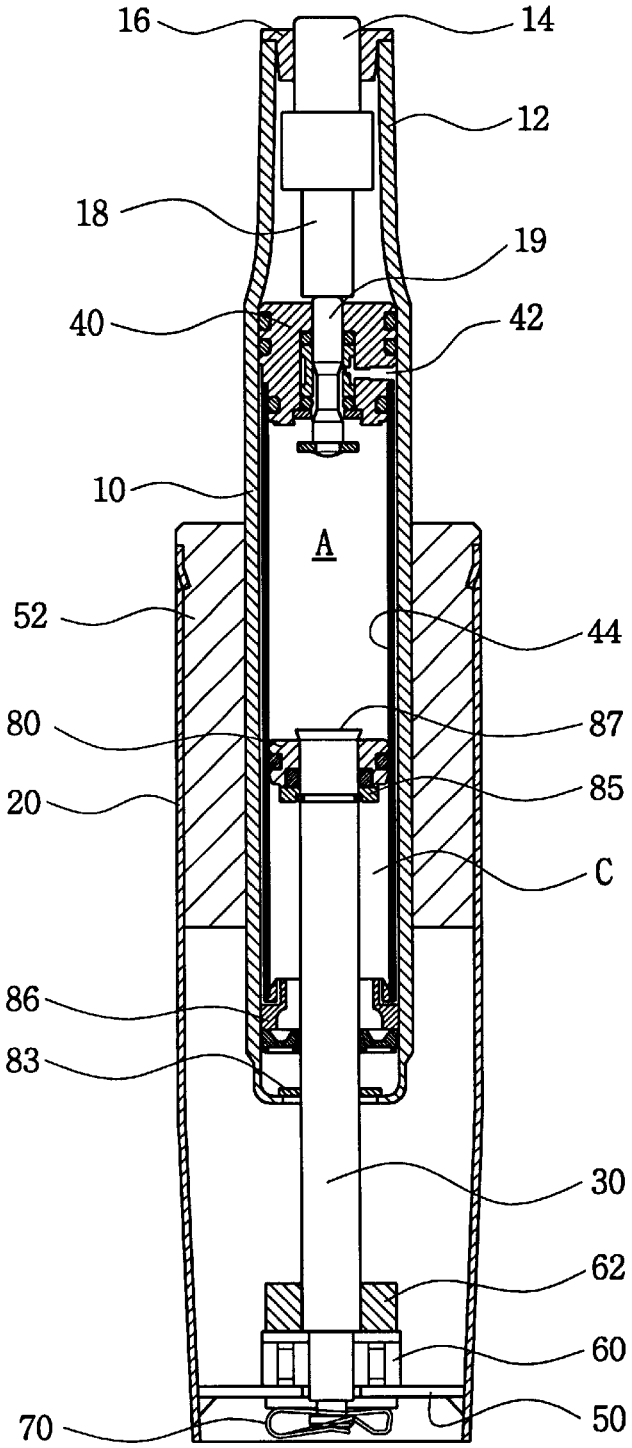
Fig. 7 PRIOR ART
FIG. 7 is a sectional view of the conventional height-adjusting apparatus of FIG. 1 for showing the descending operation of the gas cylinder type spindle.
Figure 8:
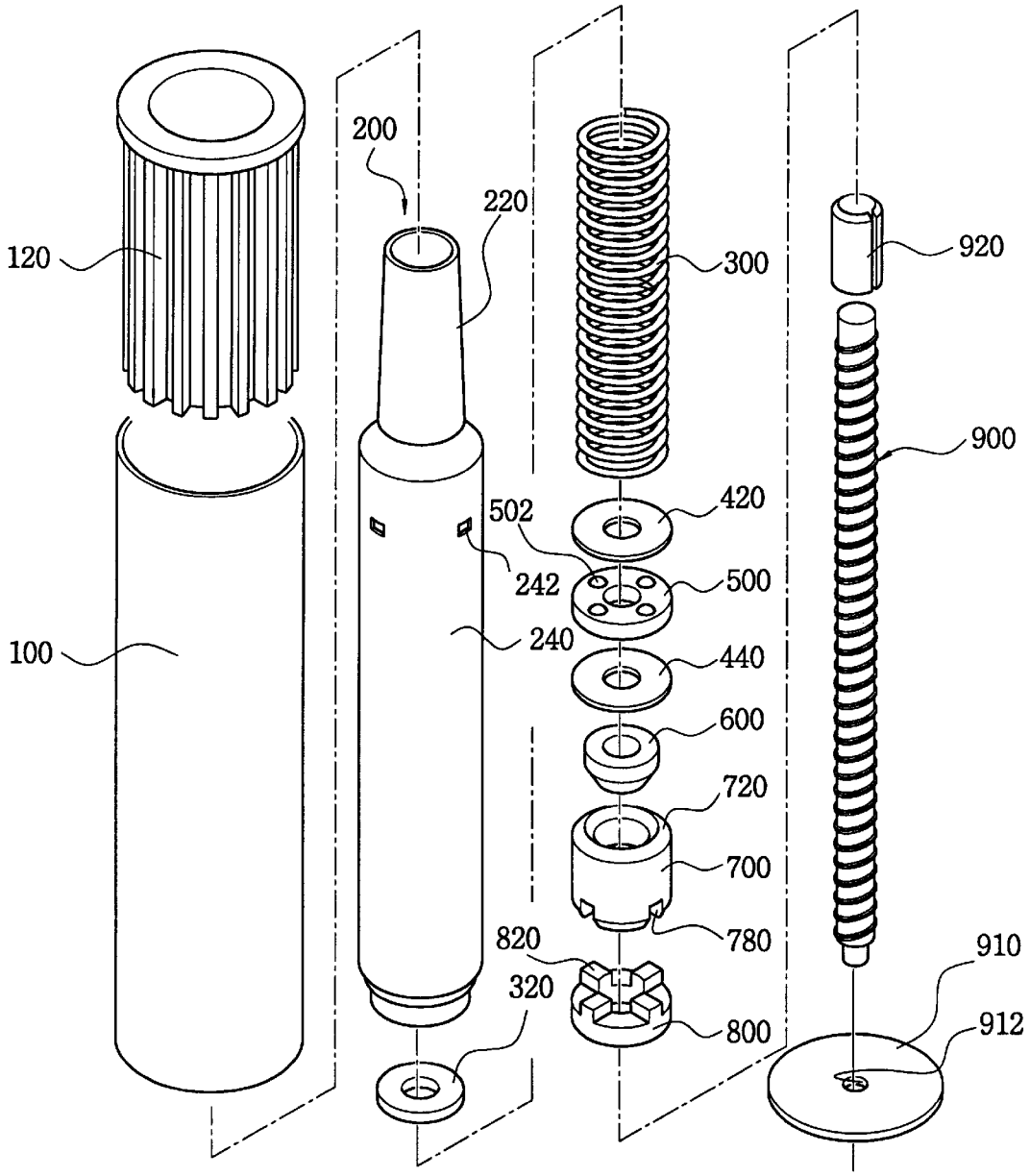
Fig. 8 PRIOR ART
FIG. 8 is an exploded perspective view of a conventional screw type height-adjusting apparatus of a swivel chair.
Figure 9:
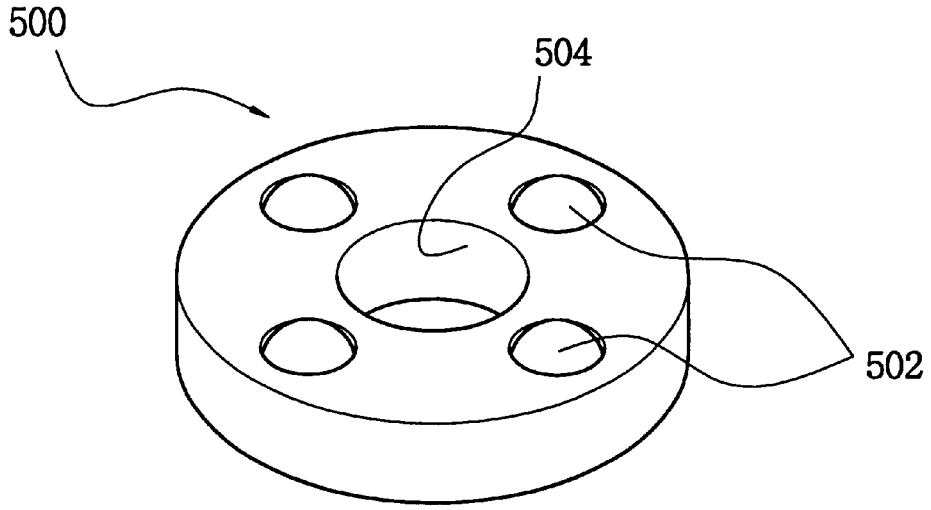
Fig. 9 PRIOR ART
FIGS. 9 and 10 are perspective views of two types of conventional shaft bearing members employed in the conventional screw type height-adjusting apparatus of FIG. 8.
Figure 10:
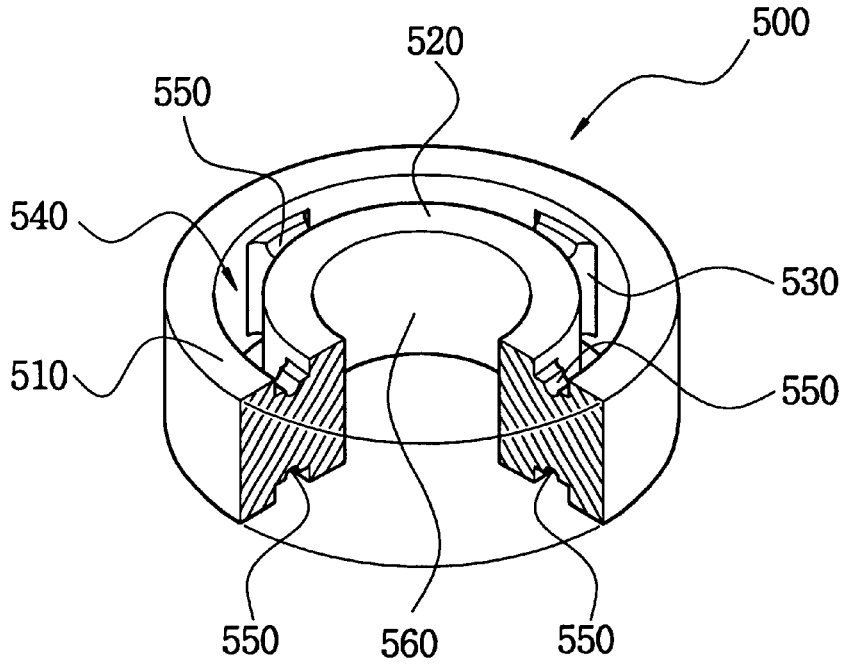
Fig. 10 PRIOR ART

As the gas in the first chamber A decreases while the gas in the third chamber C increases, the piston 180 is pushed up due to the change of the pressure difference between the two chambers, likewise with the state shown in FIG. 7. In other words, the pressure of the gas in the third chamber C, which is larger than that in the first chamber A, pushes the piston 180 up and the spindle 110 down, to thereby lower the spindle 110 down because the piston 180 is fixed to the spindle support 150 of the outer tube 120 by means of the piston rod 130.

In the height-adjusting apparatus of a swivel chair according to the present invention as described above, the holder body of the actuating pin holder is manufactured by an integral forming of a single material. Therefore, the holder body has a simple construction with reduced parts, and thereby enables its mass-production.

The piston also is manufactured by a simple coating of material after an integral forming of a single material, so that the piston also has a simple construction with reduced parts, and thereby enables its mass-production.

The actuating pin of the present invention is different from the conventional actuating pin which has a pin body and a separate washer, in that the actuating pin of the present invention does not require the steps of preparing the separate parts, and assembling the parts. Therefore, the actuating pin of the present invention reduces its manufacturing steps and cost.

The shaft bearing member of the present invention has a simple construction consisting of only one body, thereby minimizing the sliding resistance, improving its durability, and reducing the parts such as balls and bearings. Further, the shaft bearing member can be manufactured by a simple metal mold, which results in the decrease of the manufacturing cost.

The retainer washer for fixing the piston rod to the outer tube simplifies the fixing operation and makes many parts be easily handled and stored even when they are not assembled.

While the present invention has been particularly shown and described with reference to the particular embodiments thereof, it will be understood by those skilled in the art that various changes in form and details may be effected therein without departing from the spirit and scope of the invention as defined by the appended claims.

What is claimed is:

1. An apparatus for adjusting the height of a swivel chair, said apparatus comprising:

an outer tube rotatably fitted in a seat of the swivel chair;

a spindle slidably inserted in the outer tube, the spindle containing a cylinder fixed in the spindle by means of a cylinder holder disposed at a lower position of the spindle;

a piston rod fixedly contained in the outer tube and slidably inserted in the spindle through a bottom of the spindle;

an actuating pin socket fixed at a top of the cylinder, the actuating pin socket having a socket body and a socket coating coated on the socket body, the socket body having an actuating pin hole and an orifice formed in the socket body, and an annular reinforcement protruding outward from a middle portion of the socket body, the actuating pin socket being manufactured by an integral single forming, the orifice being formed through the annular reinforcement;

an actuating pin slidably fitted in the actuating pin hole; and, a piston fixed at an upper portion of the piston rod and slidably fitted in the cylinder, the actuating pin socket and the piston defining a first chamber above the piston in the cylinder, the spindle and the cylinder defining a second chamber between the spindle and the cylinder, the piston and the cylinder defining a third chamber under the piston in the cylinder, the orifice of the socket body being connected to the second chamber, the second chamber and the third chamber communicating through a gas-passing hole formed through an outer portion of the cylinder holder, the first, the second, and the third chambers containing working fluid, wherein, the actuating pin opens the orifice to communicate the first chamber with the second chamber so that working fluid can flow from the first chamber through the second chamber into the third chamber when the actuating pin is pressed down, while the actuating pin blocks up the orifice when the actuating pin is not pressed down.

2. The apparatus as claimed in claim 1, wherein the socket coating comprises a plurality of annular socket protuberances protruding from inner and outer surfaces of the socket coating, the annular socket protuberances functioning like O-rings.

3. The apparatus as claimed in claim 1, wherein the actuating pin hole is formed through a center of the socket body, the socket coating being coated on an inner cylindrical surface of the socket body in the actuating pin hole.

4. The apparatus as claimed in claim 1, wherein the piston comprises a cylindrical piston body and a piston coating coated on the piston body, the piston body being manufactured by an integral single forming and being made from metal, and the piston coating being made from elastic resin material with at least one annular protuberance.

5. The apparatus as claimed in claim 1, wherein the actuating pin has a surface hardness of HRC 40 to 60 by being subject to a treatment of barrel finishing.

6. The apparatus as claimed in claim 1, said apparatus further comprising a shaft bearing member provided at a bottom of the piston rod in the outer tube to bear a weight transferred through the piston rod, wherein the shaft bearing member has a shape of a single annular ring whose upper and lower surfaces are curved surfaces curved with a predetermined curvature.

7. The apparatus as claimed in claim 6, wherein the shaft bearing member comprises a plurality of bearing protuberances formed around a shaft hole at the lower surface of the shaft bearing member, the shaft hole being formed through a center of the shaft bearing member.

8. The apparatus as claimed in claim 6, wherein the shaft bearing member comprises a plurality of bearing protuberances formed on a middle portion of the curved surface.

9. The apparatus as claimed in claim 6, wherein the shaft bearing member is made from material selected from the group consisting of metal and hard synthetic resin.

10. The apparatus as claimed in claim 1, said apparatus further comprising a shaft bearing member provided at a bottom of the piston rod in the outer tube to bear a weight transferred through the piston rod, wherein the shaft bearing member has a shape of a single annular ring whose upper and lower surfaces are tapered surfaces tapered at a predetermined angle.

11. The apparatus as claimed in claim 10, wherein the predetermined angle is an angle within 1° to 30°.

12. The apparatus as claimed in claim 1, said apparatus further comprising means for fixing the piston rod, said fixing means being disposed between a thrust bearing and a spindle support fitted around the piston rod.

13. The apparatus as claimed in claim 12, wherein said fixing means is a retainer washer having a plurality of retaining keys protruding upward from an inner circumference of the retainer washer, the retaining keys being engaged in a plurality of piston rod grooves formed on a cylindrical surface of a lower end of the piston rod, so as to firmly fix the piston rod.

14. The apparatus as claimed in claim 12, wherein said fixing means is a retainer washer having a plurality of retaining keys protruding downward from an inner circumference of the retainer washer, the retaining keys being engaged in a plurality of piston rod grooves formed on a cylindrical surface of a lower end of the piston rod, so as to firmly fix the piston rod.

* * * * *